United States Patent [19]

Pearson et al.

[11] 3,949,584

[45] Apr. 13, 1976

[54] BENDING APPARATUS HAVING A ROLLER SUPPORT UNIT FOR E.M.T., CONDUIT AND THIN WALL TUBING

[75] Inventors: Vernon W. Pearson; Larry G. Adleman, both of Rockford, Ill.

[73] Assignee: Greenlee Bros. & Co., Rockford, Ill.

[22] Filed: Dec. 23, 1974

[21] Appl. No.: 535,873

[52] U.S. Cl. ..... 72/149; 72/157

[51] Int. Cl.[2] ..... B21D 7/024

[58] Field of Search ..... 72/149, 157, 158, 159, 72/219

[56] References Cited

UNITED STATES PATENTS

| | | | |
|---|---|---|---|
| 807,854 | 12/1905 | Neuert | 72/158 |
| 2,357,873 | 9/1944 | Bower | 72/158 |
| 2,436,776 | 2/1948 | Pearson et al. | 72/149 |
| 2,455,138 | 11/1948 | Perkins | 72/158 |
| 2,466,381 | 4/1949 | Clouse | 72/158 |
| 3,433,042 | 3/1969 | Crihfield et al. | 72/217 |
| 3,584,492 | 6/1971 | Dodge et al. | 72/159 |
| 3,621,697 | 11/1971 | Martinko | 72/219 |

FOREIGN PATENTS OR APPLICATIONS

| | | | |
|---|---|---|---|
| 151,337 | 7/1951 | Australia | 72/149 |
| 546,757 | 10/1957 | Canada | 72/154 |

*Primary Examiner*—Lowell A. Larson

*Attorney, Agent, or Firm*—James H. Bower; Mitchell J. Hill

[57] ABSTRACT

An electric driven portable conduit bender provided with a bending shoe which is rotatably mounted on a horizontal axis and including a roller support unit mounted on the bender frame and retained with a quick-release pin. The rollers in the roller support unit are rotated to match the size of conduit.

14 Claims, 5 Drawing Figures

BENDING APPARATUS HAVING A ROLLER SUPPORT UNIT FOR E.M.T., CONDUIT AND THIN WALL TUBING

BACKGROUND AND SUMMARY OF THE INVENTION

This invention relates generally to the art of bending pipe, conduit, and the like to a preselected angle.

Heretofore, portable conduit bending machines such as shown in U.S. Pat. No. 3,417,590, have been provided but it has the disadvantage of not providing easy removal of the pipe or conduit after the bend is completed on the pipe or conduit nor is the prior art provided with conduit support means for supporting a conduit in such a manner as to effectively provide for a better support of the conduit during the bending operation, and for easier removal of the conduit after the conduit has been bent to the proper angle of bend.

The conduit bender of the present invention is portable, and it is compact and light in weight, yet is capable of bending conduit in a fast, efficient and consistent manner. The portable conduit bender is electrically driven by a permanent magnet motor which is controlled by circuit means that permits the motor to be instantly stopped at the end of a bend cycle, and at the end of an unload cycle.

The conduit bender of the present invention includes a housing, on the upper end of which is rotatably mounted a bending shoe assembly which includes a bending shoe with a conduit bending hook attached thereon. The operator merely has to mount a conduit in operative position on the bender and operate a three position toggle switch mounted in a pendant on a cord that connects to the electrical control panel. By moving the switch forward, or to the bend position, the bending shoe will rotate and thereby bend the conduit until the shoe and conduit are rotated to the desired angle of bend. When the switch is released to the neutral position the bending shoe will stop its rotation. When the switch is moved to the unbend position, the bending shoe is moved in the reverse direction until the toggle switch is released to the neutral position thereby stopping further rotation of the unit.

It is the object therefore of the present invention to provide a conduit bender whereby the conduit is supported by a roller support unit during the bend, and releases the conduit when the shoe is rotated in reverse.

It is another object of the present invention to provide a roller support unit mounted on a conduit bender which is automatically retractable thereby providing for release of the conduit.

It is another object of the present invention that the roller support unit is mounted to the lower portion of the housing to provide for roller support for different sizes of conduit.

Other features and advantages of this invention will be apparent from the following detailed description, appended claims, and the accompanying drawings.

DESCRIPTION OF THE PREFERRED EMBODIMENT

Figure 1:
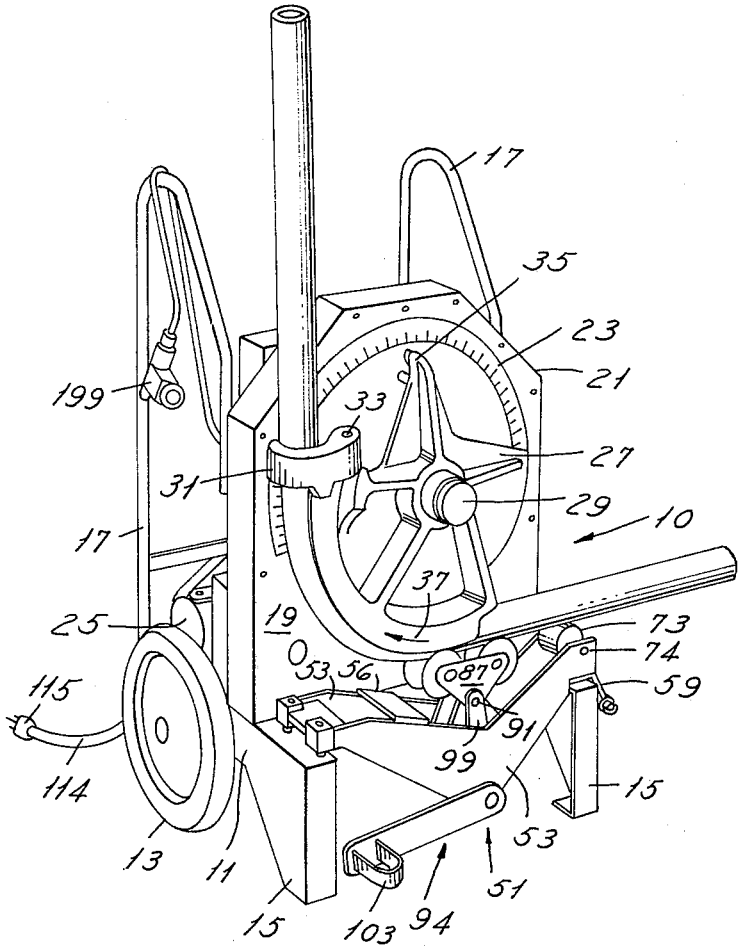
FIG. 1 is a front elevational perspective of a portable electric driven conduit bender made in accordance with the principles of the present invention.
Figure 5:
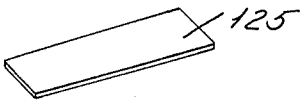
FIG. 5 shows a gage for adjusting the roller support unit.

Referring now to the drawings, and in particular to FIG. 1, reference numeral 10 generally designates a bending apparatus. The apparatus 10 comprises a rigid frame member 11 to which is mounted spaced apart wheels 13 at one end of the frame member and a pair of downwardly directed extensions or supports 15. Parallel bars 17 extend upwardly and rearwardly of the frame member 11 to provide movement and stability to the bending apparatus when the bending apparatus is rotated about the wheels 13 and the parallel bars 17 are resting upon a suitable support surface. This in effect provides for bending conduit with the apparatus horizontally or vertically disposed. However, normally the apparatus is supported vertically on the wheels 13 and extensions 15 as best shown in FIG. 1. The frame 19 of the bending apparatus comprises a semicircular portion 21 at the upper portion thereof to provide for a suitable curved scale 23 which is marked in degrees of bend. A reversible motor 25 is fixedly supported on the frame member 11 and drives the mechanism necessary to rotate bending reel or shoe 27 on shaft 29. The bending reel or shoe 27 consists of a semicircular concave groove portion at the periphery thereof to accommodate the pipe or conduit and a hook or retainer 31 pivotally connected at 33 to the end portion of the shoe 27 for retaining the conduit in alignment with the grooved portion of the shoe 27. The shoe 27 further includes a marker or pointer 35 which indicates on the curved scale 23 the position of the shoe with respect to the scale or the degree of bend.

The respective hook 31 is adapted to grasp the conduit as the shoe 27 rotates in the direction indicated by the arrow 37, whereupon the conduit follows along a selected bending groove. The conduit is prevented from moving out of the bending groove during the shoe rotation by a roller support unit 51 which in operative position provides support to the conduit in a manner to be hereinafter described.

Figure 2:
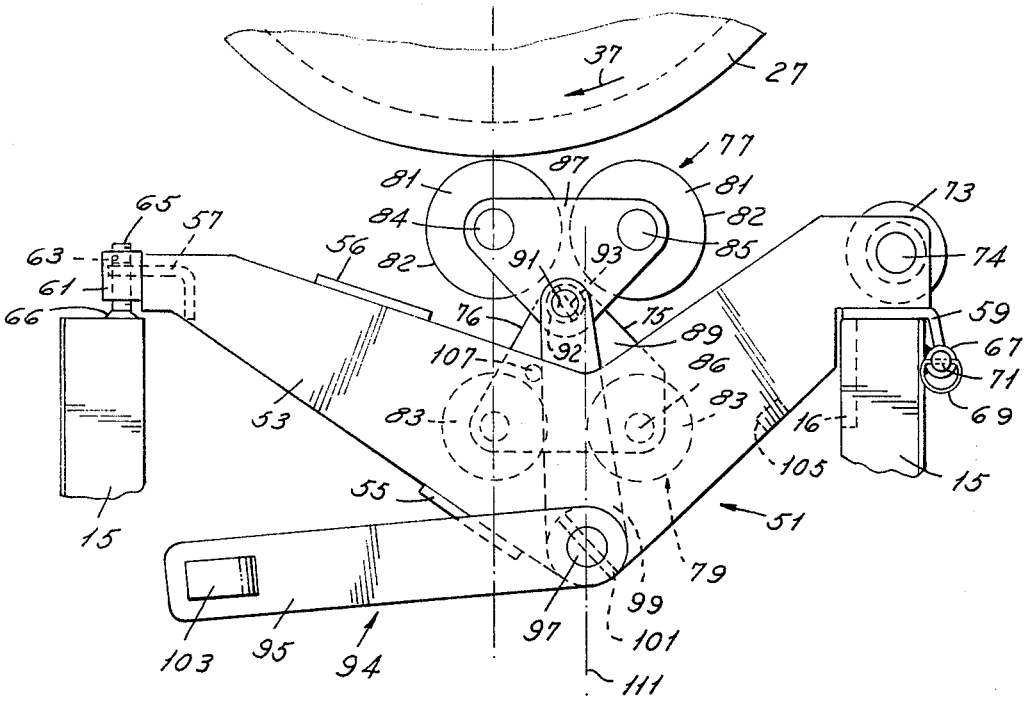
FIG. 2 is an enlarged front elevational view showing the roller support unit in the raised position for bending pipe.
Figure 3:
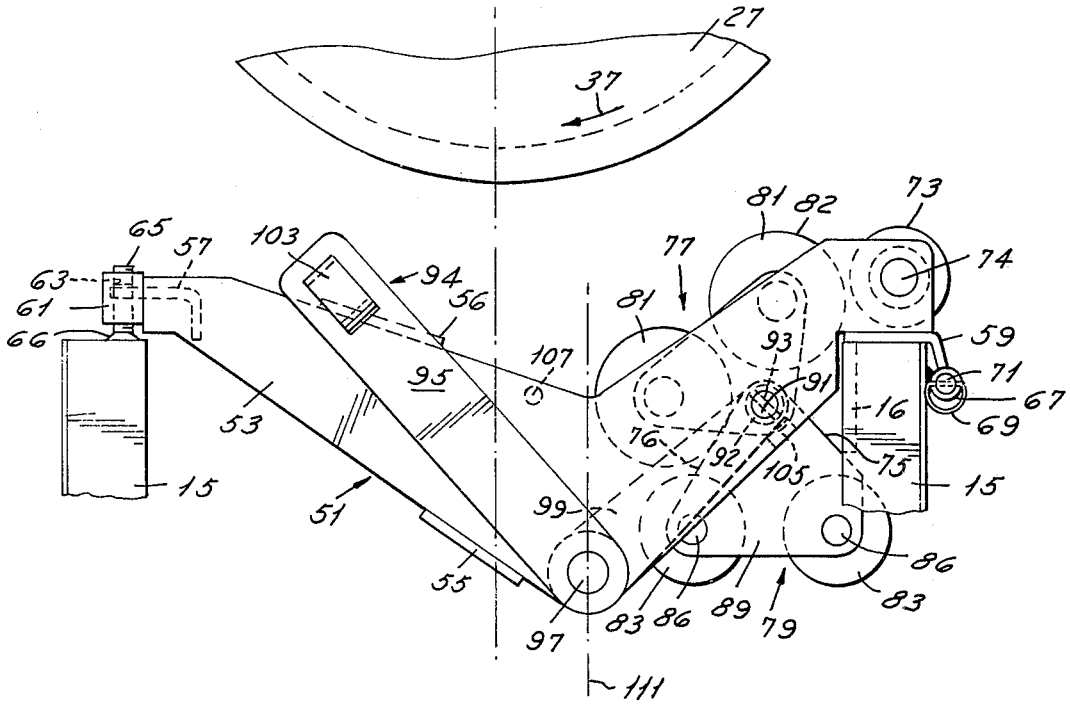
FIG. 3 is an enlarged front elevational view showing the roller support unit in the lowered position.

The roller support unit 51 comprises a pair of parallel frame members 53 spaced apart by members 55, 56, 57 and 59. Spacing members 55 and 56 are permanently connected to the parallel frame members 53 by welding or other suitable means. Spacing member 57 is permanently connected at one end of the parallel frame members 53 of the roller support unit and is attached to leveling blocks 61. Each of the leveling blocks consists of a pair of threaded bores 63 in which a flat head allen leveling screw 66 is threadedly inserted therein in one end thereof for adjustment and alignment of the roller support unit on the extension 15 of the bending apparatus. A set screw 65 is threaded into the opposite end of bore 63 to lock the flat head allen leveling screw in position. The spacing member 59 at the other end of the roller support unit is angularly shaped to provide both as a support and as a hinging mechanism. As best shown in FIG. 2 and FIG. 3, the spacing member 59 comprises a flat portion which rests on the extension 15, and an oblique portion which includes a boss 67. The boss 67 is adapted to be in juxtaposed relationship with a boss (not shown) connected to the extension 15 by a welding 69 or other suitable means. A quick release pin 71 is inserted through the bosses 67 and 69 to retain the roller support unit in proper position.

As shown in FIG. 2 and FIG. 3, the preferred embodiment illustrates two roller support units, numerically designated as 77 and 79. Each of the roller support units consists of a double set of grooved rollers, that is, roller support unit 77 comprises two grooved rollers 81 to accommodate one size of conduit, and roller support unit 79 comprises two grooved rollers 83 to accommodate a different conduit size. The upper roller unit 77, as shown in FIG. 2, comprises two rollers in tandem and is supported by pins 85 to a triangular shaped bracket 87 and secured in place against axial movement by a pair of suitable retainer rings.

The lower or smaller roller unit 79 also comprises two rollers in tandem and supported by pins 86 to a pair of trapezium shaped brackets 89 and secured in place against axial movement by a pair of suitable retainer rings. The trapezium shaped brackets 89 are mounted inside the triangular shaped brackets 87 and connected at the vertices of each of the triangular and trapezium shaped brackets on a common shaft or roller pivot pin 91. The trapezium shaped brackets 89 are maintained adjacent to the outer triangular shaped brackets 87 by a spacer 92 which is secured to the shaft 91 by means of a fastening means such as a roll pin 93.

It is to be noted that the size of triangular shaped bracket 87 is different than the size of trapezium shaped bracket 89. This is due to the fact that the rollers 83 of the lower roller unit 79, as shown in FIGS. 2 and 3, are for smaller conduit, that is, for 1½ inch EMT, while those rollers 81 of the upper roller unit 77 are for 2 inch EMT. Consequently, the roller unit 79, when in the operational or bending position must be closer to the shoe 27 and therefore, the trapezium shaped bracket 89 must be larger than the triangular shaped bracket 87.

The roller units can be interchangeable at will, by moving the upper roller unit either clockwise or counterclockwise until the lower unit now moves to the top only when the lever arm 99 is in mid-position. The roller units are held in place by gravity and balance, however, it is well within the purview of one skilled in the art to provide detent means to retain the roller units in proper operational position. The roller units move either clockwise or counterclockwise only within approximately 340° rotation. That is, the 2 inch EMT upper roller support unit comprises a pin 84 which extends past triangular shaped bracket 87 and therefore cannot rotate about pin 91 past arm 99 when rotated in a counterclockwise direction as viewed in FIG. 2. However, the both roller units move clockwise, as viewed in FIG. 2, until pin 84 strikes the other side of arm 99, thereby preventing further rotation in that direction. The lower, or 1½ inch EMT roller units, comprises trapezium brackets 89 with edges 75 and 76 which contact edges 82 of rollers 81 thereby preventing any further clockwise or counterclockwise rotation of the 2 inch EMT roller units.

A polyurethane back support roller 73 is rotatably mounted on shaft 74 for the purpose of providing a support to the conduit. The shaft 74 is mounted against axial movement by a pair of suitable retainer rings.

To raise or lower the roller support unit into operative and inoperative positions, a lever unit 94 is connected to the upper and lower roller units by the roller pivot pin 91. The lever unit 94 comprises a lever arm 95 which is permanently connected to shaft 97 and pair of arms 99 secured to shaft 97 by means of a pin 101. Thus, it is readily observed that movement of the lever arms 99 between stops 105 and 107, the roller support units can be moved into inoperative and operative positions, respectively. A metal looped foot pedal 103 is secured to one end of the lever arm 95 to facilitate movement thereof by means of the foot. The stop means or bracket 105 is secured to the inner walls of the parallel frame members 53 and contacts arm 99 to prevent further movement of the roller support units when in inoperative position. That is, the roller support unit, when dropped to an inoperative position, allow for easy retraction of the bent conduit in a manner hereinafter described. The edges 82 of rollers 81 will rest on edge of bracket 59 and edge 75 of bracket 89 rests against the wall 16 of supports 15 and arms 99 will rest on stop 105 attached to parallel frame members 53.

As shown in FIG. 2, the roller support unit is in the raised or operative or conduit bending position and arm 99 is held against further movement by bracket or stop 107. As shown in FIG. 1, when the conduit is being bent by movement of the shoe 27 in a direction indicated by arrow 37, a force is applied between the shoe 27 and the upper roller units 77. The force applied when the conduit is being bent in the direction indicated forces the roller support unit to the left, as viewed in FIG. 2, and slightly over center of axis 111 and held against further movement by arm 99 against stop 107. Upon actuation of the reverse button, the shoe is then rotated counterclockwise, or in a reverse direction to that shown by arrow 37. Thus, the forces between the shoe and the roller units will cause the roller pivot pin 91 of the upper roller support unit to shift to the other, or right side, of axis 111 as viewed in FIG. 2. Consequently, the roller support unit immediately drops down because of gravity to the stop means 105 and automatically out of the way of the bent pipe to permit radial and axial movement of the bent conduit for removal therefrom the bending shoe.

Figure 4:
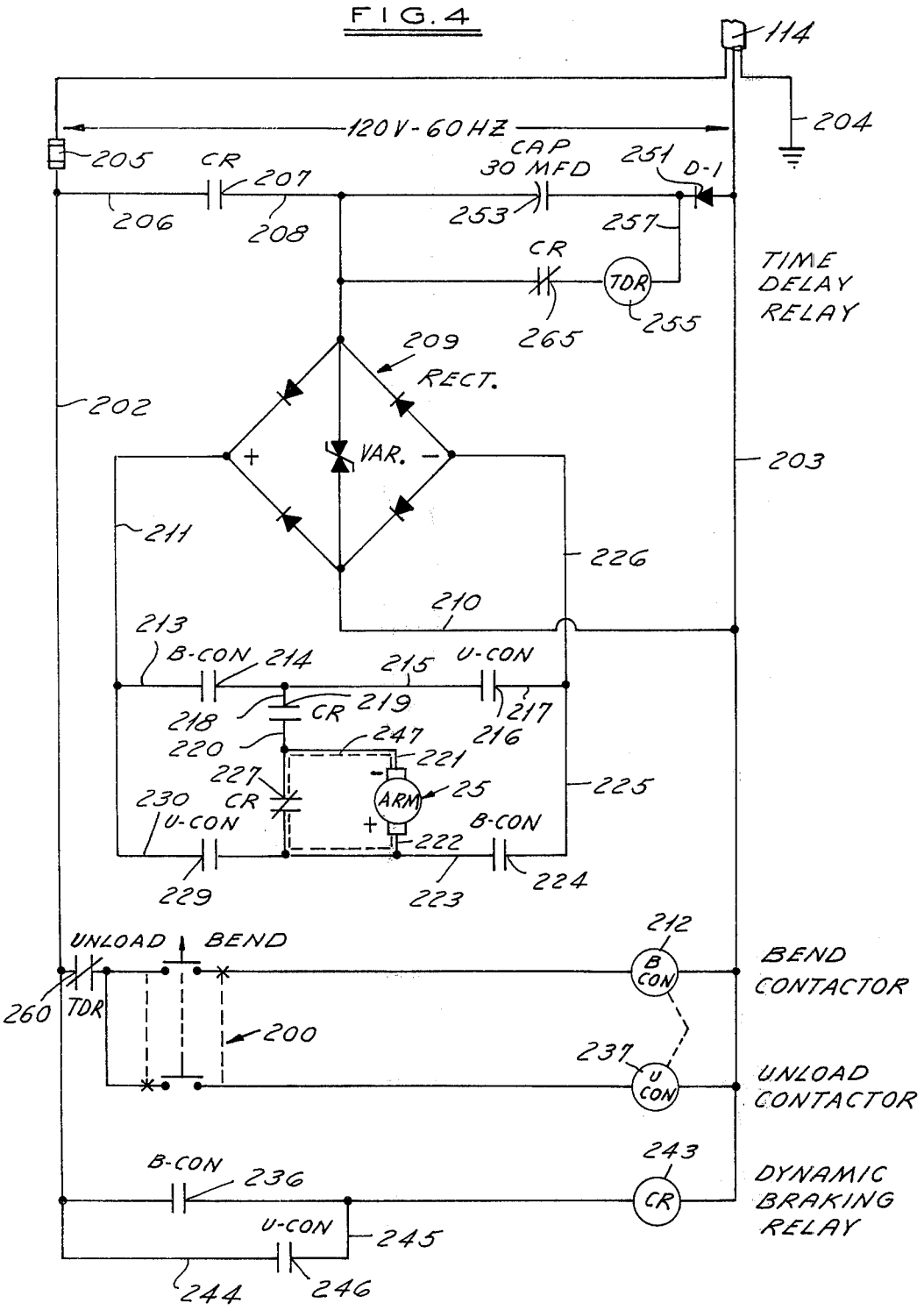
FIG. 4 is a schematic diagram of a suitable electric control circuit employed in the invention.

FIG. 4 is a schematic diagram of an illustrative electric control conduit for controlling the operation of the conduit bender of the present invention. However, it will be understood that other suitable control circuits may be employed. The numeral 115 operatively connected to the three-conductor cable 114, as shown in FIG. 4, and which includes two conductors 202 and 203 and the ground lead wire 204. The conductor 202 includes a conventional fuse 205. The AC power is converted by a suitable rectifier 209 into DC current for energizing the permanent magnet motor 25, as permanent magnet motor 25, as more fully described hereinafter. As shown in FIG. 4, a toggle switch 200 mounted in the pendant switch 199 is operatively connected in a circuit between the conductors 202 and 203, which includes the bend contactor coil B-CON 212. Pressing the toggle switch 200, to the bend position, energizes the bend contactor oil B-CON 212, thereby operating the bend contactor relay contacts. The normally open bend contacts B-CON 236 is closed thus energizing the dynamic braking relay coil CR 243. The two normally open bend contacts B-CON 214 and B-CON 224 are also closed. The energizing of the dynamic braking relay coil CR 243 closes the CR contacts 207 which completes a circuit between the conductors 202 and 203 through the lead wires 206, 208, and 210 to energize the full wave bridge rectifier 209. The normally closed CR relay contacts 277 is opened before the normally open CR relay contacts 219 closes and it is apparent that the energization of the dynamic braking relay coil, CR 243, completes a circuit to energize the permanent magnet motor 25. In turn, the permanent magnet motor 25 turns the bending shoe 27 through a suitable mechanical drive in a clockwise direction, as viewed in FIG. 2, and indicated by arrow 37. The permanent magnet motor 25 is supplied with DC current from the rectifier 209 through the lead wires 211 and 213, the bend contacts B-CON 214, lead wire 218, CR relay contacts 219, lead wires 220, 221, 222, and 223, bend contacts B-CON 224 and lead wires 225 and 226.

The permanent magnet motor 25 continues to rotate the bending shoe 27 as long as the toggle switch button is depressed. When the angle desired is reached, the toggle switch is released to the neutral position, thus opening the contacts of toggle switch 200 and de-energizes the bend contactor coil B-CON 212. De-energization of coil B-CON 212 opens contacts B-CON 236 and de-energizes the dynamic braking relay coil CR 243, the aforedescribed rectifier and permanent magnet motor energizing circuits. De-energizing the CR 243 relay coil closes the CR 227 contacts and thus shorts the armature of the permanent magnet motor 25 by producing a dynamic braking effect on the motor. The broken line path of the dynamic braking is indicated by the numeral 247 in FIG. 4.

The unload cycle is initiated by depressing the toggle switch 200 to the unload position which energizes the unload contactor coil U-CON 237. The toggle switch is mechanically interlocked and thus prevents the bend contactor coil B-CON 212 and the unload contactor coil U-CON 237 to be simultaneously operated. The unload toggle switch position is operatively connected in a circuit between the conductors 202 and 203 to energize the unload contactor coil U-CON 237. Energization of the U-CON 237 coil closes normally open contacts U-CON 246 to complete a circuit through the lead wires 244 and 245 and through the dynamic braking relay coil CR 243. The normally open unload contacts U-CON 216 and U-CON 229 are also closed.

The normally open contacts CR 219 are closed to again complete the aforedescribed circuit between the conductors 202 and 203 to energize the full wave bridge rectifier 209. The normally closed relay contacts CR 227 is opened before the normally open relay contact CR 219 closes. The energization of the dynamic braking coil CR 243 and unload contactor coil U-CON 237 effects a reversing of the rotation of the permanent magnet motor 25 to turn the bending shoe 37 in a counterclockwise direction, to return the shoe to its initial position. The permanent magnet motor 25 is supplied with DC current from the rectifier 209 through the lead wires 211 and 230, the unload contacts U-CON 229, the lead wires 222, 221 and 220, the now closed relay contacts CR 219, the lead wires 218 and 215, the unload contacts U-CON 216, and the lead wires 217 and 226. The reverse rotation of the permanent magnet motor 25 rotates the shoe in a counterclockwise manner until the pointer 35 is matched with the zero marking on the scale 23. The toggle switch is then released to the neutral position and thus the normally open contacts of the unload contactor coil U-CON 237 open, the normally open contacts of the CR 237 coil open, and the relay contacts CR 227 closes to effect a shorting of the armature of the permanent magnet motor 25 to stop the motor in milliseconds and provide a dynamic braking effect on the shoe 37. The bent conduit is removed from the conduit bender when the shoe has been rotated counterclockwise approximately 10° – 15° from the final bend position. The shoe is further rotated counterclockwise until the pointer 35 reaches 0° on the scale 23 and then the apparatus is ready for the next bending operation.

The dynamic braking relay coil CR 243 is activated by either the bend or unload contactor. It has two sets of double pole contacts. Where the coil is activated by either the bend or unload contactor it makes a connection to the minus side of the motor 25 from either the bend or unload contacts. It also makes a connection to provide A.C. current to the rectifier 209 and also to charge a 30 microfarad capacitor 253. The 30 microfarad capacitor 253 is connected to the time delay relay TDR 255 through lead wire 257.

When the dynamic braking relay coil CR 243 is deactivated or de-energized, the motor armature is shorted to provide a dynamic braking effect. The dynamic braking relay is so interlocked that when the motor armature is shorted out for dynamic braking, power cannot be applied to the motor for a selected time interval. The control relay contacts CR 265 is interlocked with the time delay relay coil TDR 255 so that the dynamic braking relay is de-energized when A.C. power is applied to the rectifier 209.

The function of the time delay relay is to prevent rapid reversal of the motor which would de-magnetize the motor magnets. The time delay contacts TDR 260 interrupts power to the toggle switch. When the relay CR 243 is de-energized the time delay relay coil TDR 255 is connected to the 30 microfarad capacitor, which has been charged with D.C. current through the diode 251. The capacitor discharges into the time delay relay coil TDR 255, causing the time delay relay contacts TDR 260 to interrupt power to the toggle switch 200 for 1 to 1.5 seconds.

A suitable relay to carry out the function of the dynamic braking relay coil CR 243 is a general purpose power relay available from Struthers-Dunn, Inc., Pitman, New Jersey under Model No. 425XBXW. A suitable reversing contactor for carrying out the functions of the bend contactor 212 and the unload contactor 237 is available from Struthers-Dunn, Inc., Pitman, New Jersey, under Model No. 575KXX. A suitable toggle switch for carrying out the functions of the unload and bend switching means is a toggle switch available from Cutler-Hammer, Milwaukee, Wisconsin, under Model No. 7905-K5.

The operational procedures are as follows: A straight pipe or conduit is loaded as shown in FIG. 3, resting on rear roller support 75, and hook 31 of bending reel 27 encircling pipe or conduit. The toggle switch 200 is pressed in the bend position and pressure is simultaneously put on bracket 103 to move roller support unit under the straight conduit portion and that both rollers 81 move underneath the straight portion of the conduit. Further rotation of the shoe simultaneously with pressure on bracket 103 causes the arm 99 to move over axis of center line 111 until it reaches stop 107. Rotation of the shoe 27 bends the conduit around to form the desired bend. After the bend has been established, the toggle switch is pressed to the unload position causing rotation of the shoe 27 in the reverse direction and causing the bent pipe still in the shoe to move counterclockwise causing movement of the rollers and arm 99 to move over the axis of center line 111 or to the right as shown in FIG. 2. Immediately after arms 99 move past axis of center line 111, the entire roller unit drops down to the lower rest position as shown in FIG. 3.

Shown in FIG. 4 is a gage 125 which provides for adjustment of the roller support unit for the 2 inch EMT only. The setting gage is placed on the two form rollers 81 and the rear urethane support roller 73. The flat head allen leveling screws 66 are adjusted until the gage contacts all three rollers and the lowermost groove or concave portion at the bottom of the shoe 27. That is, the flat head leveling screws are adjusted until the gage just contacts the shoe groove at its deepest point, and contacts all three rollers simultaneously. The leveling screws 66 are then locked in place by the set screws 65.

While it will be apparent that the preferred embodiment of the invention herein disclosed is well calculated to fulfill the objects above stated, it will be appreciated that the invention is susceptible to modification, variation and change.

What we claim is:

1. In a portable conduit bending apparatus having a frame, a bending shoe mounted on a rotatable shaft, and means to rotate said bending shoe, the improvement comprising a roller support unit mounted on said frame, said roller support unit comprising:

1. a pair of parallel frame members (53) extending under said bending shoe (27) normal to said rotatable shaft (29);

2. spacing means (55, 56, 57, 59) connecting said parallel frame members to provide spacing therebetween;

3. a first pivot means (97) at the approximate midlength of said parallel frame members having an axis parallel to said rotatable shaft (29);

4. arm means (99) connected to said first pivot means (97) at one end thereof;

5. a second pivot means (91) mounted at the other end of said arm means;

6. roller means rotatably supported on said second pivot means (91); and

7. stop means mounted on said parallel frame members;

wherein said roller means is adapted to be positioned between an operative and an inoperative position.

2. The invention as defined in claim 1 wherein said stop means mounted on one of said parallel frame members includes a pair of stop brackets (105, 107) adapted to stop said arm means (99) in an inoperative and operative position, respectively.

3. The invention as defined in claim 1 wherein said roller means comprises two rollers in tandem.

4. The invention as defined in claim 1 wherein said roller means comprises:

a. a first set of roller (77) means mounted on said second pivot means (91); and b. a second set of roller (79) means mounted on said second pivot means;

wherein each of said first and second set of roller means is adapted to be interchanged for adaptation to different conduit size.

5. The invention as defined in claim 1 wherein a lever arm means (95) is mounted on said first pivot means (97) to move said roller means into an operative or an inoperative position.

6. The invention as defined in claim 1 wherein said roller support unit is adjustable (65, 66) at the other end of said parallel frame members.

7. The invention as defined in claim 4 wherein said roller unit is detachably pivotable (67, 69, 71) to said frame of said portable conduit bending apparatus.

8. In a portable conduit bending apparatus having a frame, a bending shoe mounted on a rotatable shaft, and means to rotate said bending shoe, the improvement comprising a roller support unit mounted on said frame, said roller support unit comprising:

1. a pair of parallel frame members (53) extending under said bending shoe (27) normal to said rotatable shaft (29);

2. spacing means (55, 56, 57, 59) connecting said parallel frame members to provide spacing therebetween;

3. a first pivot means (97) at the approximate midlength of said parallel frame members having an axis parallel to said rotatable shaft (29);

4. arm means (99) connected to said first pivot means (97) at one end thereof;

5. a second pivot means (91) mounted at the other end of said arm means;

6. a pair of brackets (87) mounted on said second pivot means (91);

7. roller means (77) mounted between said pair of brackets and rotatably supported on said second pivot means (91); and

8. stop means mounted on said parallel frame members;

wherein said roller means is adapted to be positioned between an operative and an inoperative position.

9. The invention as defined in claim 8 wherein said stop means mounted on one of said parallel frame members includes a pair of stop brackets (105, 107) adapted to stop said arm means (99) in an inoperative and operative position respectively.

10. The invention as defined in claim 8 wherein said roller means comprises two rollers in tandem.

11. The invention as defined in claim 8 wherein said roller means comprises:

a. a first set of roller (77) means mounted between said pair of brackets on said second pivot means (91);

b. a pair of trapezium shaped brackets mounted on said second pivot means adjacent the first pair of brackets; and c. a second set of roller (79) means mounted on said second pivot means and between said trapezium shaped brackets and said second set of roller means is positioned opposite said first set of roller means;

wherein each of said first and second set of roller means is adapted to be interchanged for adaptation to different conduit size.

12. The invention as defined in claim 8 wherein a lever arm means (95) is mounted on said first pivot means (97) to move said roller means into an operative or an inoperative position.

13. The invention as defined in claim 8 wherein said roller support unit is adjustable (65, 66) at the other end of said parallel frame members.

14. The invention as defined in claim 8 wherein said roller unit is detachably pivotable (67, 69, 71) to said frame of said portable conduit bending apparatus.

* * * * *